United States Patent [19]

Fukuoka

[11] 4,020,569

[45] May 3, 1977

[54] SOLE OF A FOOTWEAR

[76] Inventor: Tatsuo Fukuoka, No. 3, 3-ban, 2-chome, Shin-Minami-Fukushima, Tokushima, Japan

[22] Filed: Aug. 11, 1975

[21] Appl. No.: 603,303

[30] Foreign Application Priority Data

May 1, 1975 Japan ..... 50-60450[U]

[52] U.S. Cl. ..... 36/29; 36/11.5; 36/30 R

[51] Int. Cl.² ..... A43B 13/20; A43B 3/12; A43B 13/12

[58] Field of Search ..... 36/11.5, 3 R, 3 B, 30 R, 36/32 R, 28, 29, 35 R, 37, 35 B

[56] References Cited

UNITED STATES PATENTS

| | | | |
|---|---|---|---|
| 547,645 | 10/1895 | Lacroix | 36/29 |
| 3,608,215 | 9/1971 | Fukuoka | 36/29 |
| 3,698,107 | 10/1972 | Fukuoka | 36/11.5 |
| 3,834,046 | 9/1974 | Fowler | 36/30 R |

*Primary Examiner*—Patrick D. Lawson

[57] ABSTRACT

A sole of a footwear comprises a soft sole body provided at a rear half thereof with at least one upwardly opening recess and a rigid or semi-rigid reinforcing plate serving also as an insole which is mounted on said rear half of said sole body so as to cover said recess.

8 Claims, 10 Drawing Figures

SOLE OF A FOOTWEAR

The present invention relates to a sole (including an outersole, an insole and a heel section) of a footwear such as a shoe, sandal or the like, particularly to a sole which permits the improvement of walking efficiency, prevents a fatigue of a wearer's foot from long time wear and increases comfortableness-to-wear.

When a sole is formed soft all over and therefore flexible, a wearer can walk at a speedy space and sufficiently tread on the sole, obtaining an improved walking efficiency. In view of this, it may be considered that a thoroughly soft sole is better. On the other hand, however, long time standing or walking in such a soft sole makes a wearer's foot fatigued.

Therefore, the front and rear halves of a sole require different conditions respectively depending on the functions exercised in the walking action. The front half of the sole requires softness and flexibility so as to improve walking efficiency. On the contrary, the rear half inevitably requires hardness and inflexibility since a heel, the main portion of a foot, is disposed thereon. When the rear half of a sole is inflexible, a foot is stably and comfortably supported, being free from fatigue.

Further, a sole as a whole requires resiliency and pliability. If the front and rear halves are completely separately formed of soft and hard materials respectively with the intention of meeting the above-mentioned different requirements at the same time, the sole as a whole is not provided with resiliency and pliability, and due to a border formed between the two halves, the footwear becomes uncomfortable to wear and easy to break to shorten its life. In view of these respects, the inventor has succeeded in developing a sole which can fulfill the different and common requirements of the front and rear halves at the same time, thereby improving durability of a footwear as well as making it comfortable to wear.

Therefore, in a sole according to the present invention, a sole body comprising a front and rear halves is formed of non-rigid synthetic resin material, and the rear half of the sole body is provided with upwardly opening recesses, and at the same time a rigid or semi-rigid reinforcing plate (shape-retaining plate) of a suitable thickness also serving as an insole is mounted on the upper surface of at least the rear half.

In a preferred embodiment of the present invention, a sole body is molded of a suitable composition of soft vinyl chloride, plasticizer, stabilizer or the like mixed with foaming agent by a molding method including a foaming step, whereby the sole body is provided with desirable resiliency and pliability. The rear half of the sole body is provided with a plurality of upwardly opening recesses and a reinforcing plate also serving as an insole mounted thereon so as to cover the recesses. The reinforcing plate may be formed of polyethylene, polypropylene, nylon or ABS resin or similar kind of hard synthetic resin material, or composite material of synthetic resin and metal, said plate providing the rear half of the sole body with rigidness and shape-retaining property. For mounting the plate on the upper surface of the rear half of the sole body, a plurality of downward projections are integrally provided on the lower surface of the reinforcing plate, while a plurality of holes corresponding to the projections are provided on the upper surface of the rear half of the sole body so that by fitting the projections into the holes the rigid reinforcing plate is fixed on the sole body. In the required positions of the recesses there may be provided dermatophytosis medicine, a drying agent, deodorizer, aromatic agent and/or cutitis medicine.

The reinforcing plate may be adapted either to cover only the rear half surface of the sole body or may be extended to the front half surface so as to cover the whole of the sole body. In the latter case, the front half of the reinforcing plate is to be thinner so as to obtain flexibility.

When walking in a sandal provided especially with a reinforcing plate only on the rear half of the sole body, the surface of the heel section of the sandal momentarily leaves the footsole, thereby eliminating difficulties in walking.

Further, by providing a plurality of grooves upwardly opening and communicated with one another and further communicated with the recesses in the rear half of the sole body, the rear half of the sole body is repeatedly subject to compression and restoration actions caused by the displacement of the wearer's weight to increase or decrease the capacity of each recess thus effecting pumping action. In other words, the recesses serve as pumping chamber and air compressed therein flows through the grooves communicated with the recesses toward the front half of the sole body or into the front portion of the upper. Further, the grooves in the front half, when covered with a foot put thereon, form tubular spaces. And when the tubes come to the open state, the recesses take suction action, while when the rear half of the sole body shifts from the compression action to the restoration action the air in the front half returns to the recesses in the rear half of the sole body. In this manner, air inside the footwear can continuously flow, so that air can pass between the footsole and the surface of the sole body. And especially in case of a shoe, outer air can be flowed into the upper, or wet air inside the upper exhausted outside according to the abovementioned air flow, thus effecting so-called ventilation. A number of grooves provided in the front half of the sole body can effect a pumping action due to the increase or decrease in the capacity therof caused by the flexion of the front half of the sole body in the walking action. Therefore, ventilation can be effected only by the front half. Further, the grooves can help the air in the pumping chamber to flow out.

Besides, by providing recesses in the rear half of the sole body so as to open upwardly, soil or pebble is prevented from entering from the bottom surface into the recesses. Since the recesses are defined on the upper portion of the sole body instead of the lower potion as in the conventional method, larger capacity of recesses can be formed thereby making the shoe the lighter. It is because the sole becomes unstable when large recesses are formed in the lower surface thereof, decreasing the ground contact area.

Other features and advantages of the present invention will become more apparent from the following description of the embodiments given with reference to the appended drawings, in which.

Figure 1:
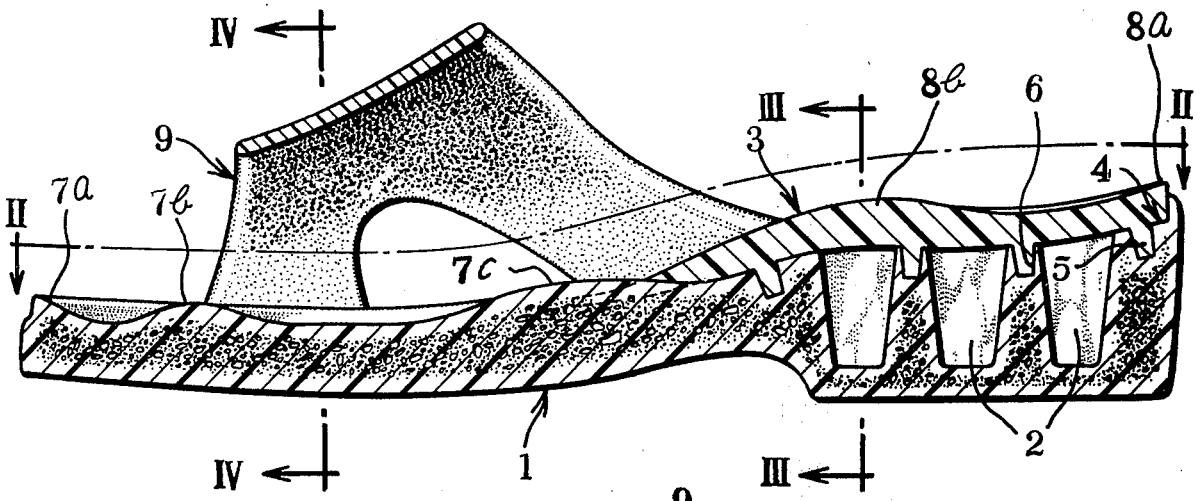
FIG. 1 is a longitudinal section of a sandal of an embodiment of the present invention.
Figure 2:
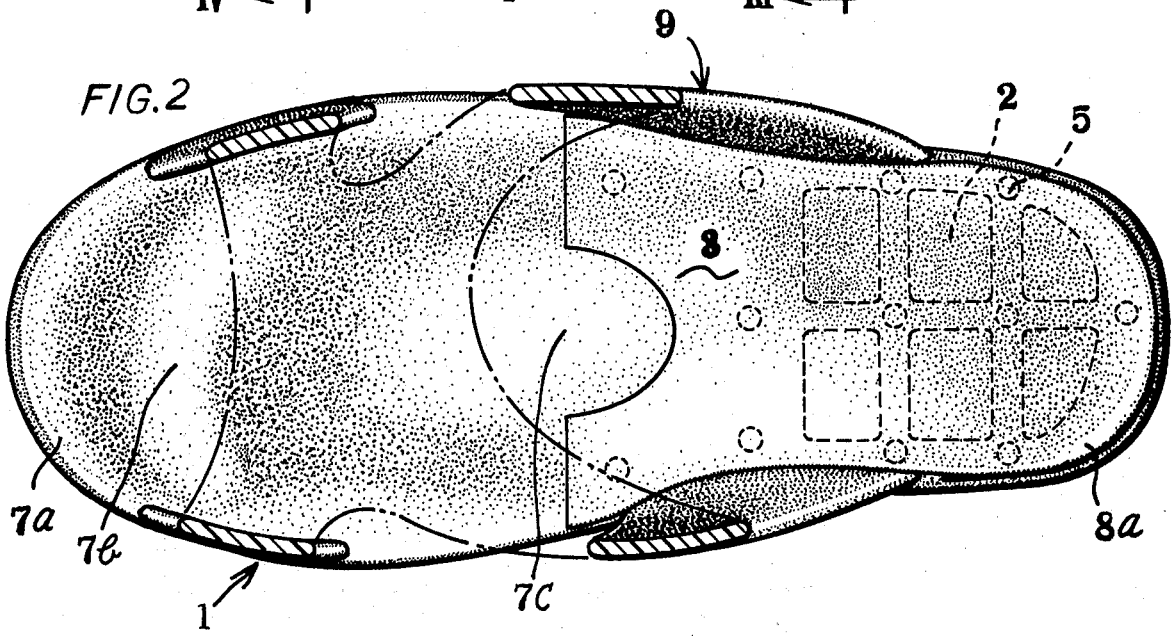
FIG. 2 is a plan view of the sandal of FIG. 1.
Figure 3:
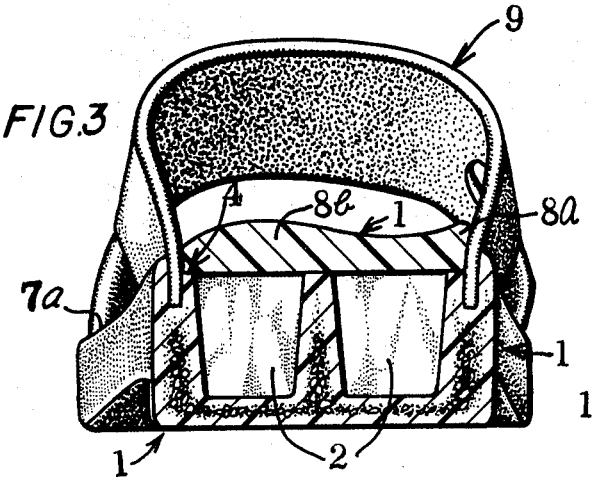
FIG. 3 is a section taken along the line III — III of FIG. 1.
Figure 4:
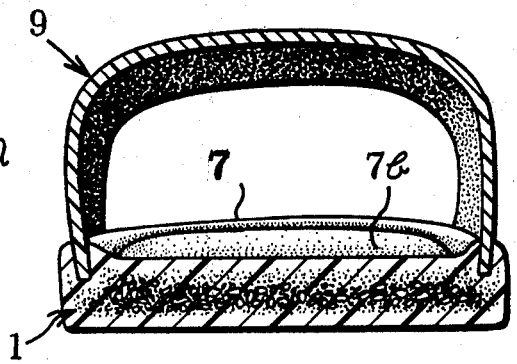
FIG. 4 is a section taken along the line IV— IV of FIG. 1.

FIGS. 1 – 3 illustrate a sandal. In the drawing there is shown sole body 1 formed of non-rigid plastics material. For example, the sole body is molded of non-rigid PVC compound comprising 100 parts of vinyl chloride resin, 70 parts of dioctyl phthalate(plasticizer), 20 parts of azodicarbonamid(foaming agent), 3 parts of stearate(stabilizer), 0.5 part of stearic acid(smoothing agent), a suitable coloring agent and others. The sole body 1 has a relatively hard non-foamy surface layer, and soft and pliable foamed inside. The rear half of the sole body 1 is provided with a plurality of recesses 2 . . . opening upwardly or in the upper surface of the sole body. Numeral 3 indicates a reinforcing plate serving also as an insole. The reinforcing plate 3 is formed of rigid plastics material and has a suitable thickness so as to prevent the flexion of the rear half. The plate 3 is fitted into the recesses provided on the upper surface of the rear half of the sole body, forming also an insole in continuation with the upper surface of the front half of the sole body. The plate 3 is formed e.g. of a rigid PVC compound comprising 100 parts of vinyl chloride resin, 3 parts of dioctyl phthalate (plasticizer), 3 parts of stearate, 0.5 part of stearic acid, a suitable coloring agent and the like. If 10 – 15 instead of 3 parts of dioctyl phthalate is used in this compound, semi-rigid vinyl chloride compound is obtained. The plate 3 serving also as an insole is provided with a plurality of projections 5 . . . extended integrally from the lower surface thereof, the projections 5 . . . being fitted into holes 6 . . . provided in the upper surface of the rear half of the sole body whereby the plate 3 is fixed to the sole body 1.

On the surfaces of the sole body 1 and the reinforcing plate 3 there are provided raised peripheral portions 7*a* and 8*a* in such a manner that the periphery of the whole sole is outwardly raised by a gradual slope. Further, raised portions 7*b* and 7*c* are formed on the front half surface corresponding to the joint of foot fingers and in an intermediate recessed portion corresponding to the arch of the foot, respectively so as to follow the shape of a foot sole. The reinforcing plate is partly cut away in the portion corresponding to the raised portion 7*c*.

Figure 5:
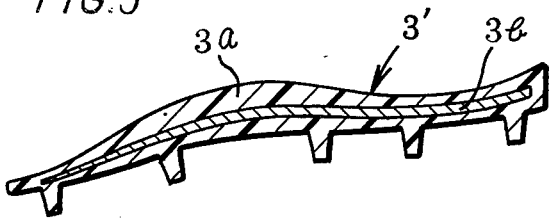
FIGS. 5 and 6 are longitudinal sections of modifications of the reinforcing plate in the sole of FIG. 1.

A reinforcing plate 3′ serving also as an insole as shown in FIG. 5 comprises synthetic resin section 3*a* of non-rigid, rigid or semi-rigid synthetic resin material and a metal plate section 3*b* embedded in the said synthetic resin section 3*a*.

Numeral 9 indicats a band with two ends embedded in the sole body 1. For example, the two ends of a performed band are inserted into a sole body molding cavity and molten synthetic resin is injected thereinto, whereby a sole body is molded and at the same time the band and the sole body are connected together. Alternatively, a sole body and a band may be preliminarily formed respectively and then connected together by an adhesive agent or by seaming.

Figure 6:
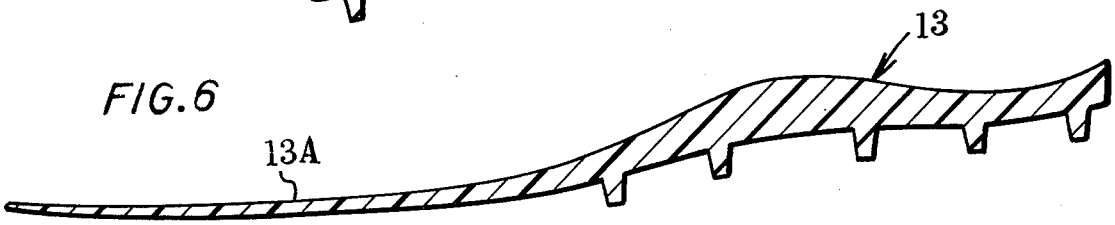

FIG. 6 illustrates a reinforcing plate 13 serving also as an insole formed of rigid synthetic resin material by extending a reinforcing plate 3 as shown in FIG. 1 onto the front half of the sole body so as to cover substantially the whole of the upper surface of the sole body, the extended front half of which is formed relatively thinner so as not to lose flexibility thereof. Such a reinforcing plate 13 is preferably applied to a shoe.

Figure 7:
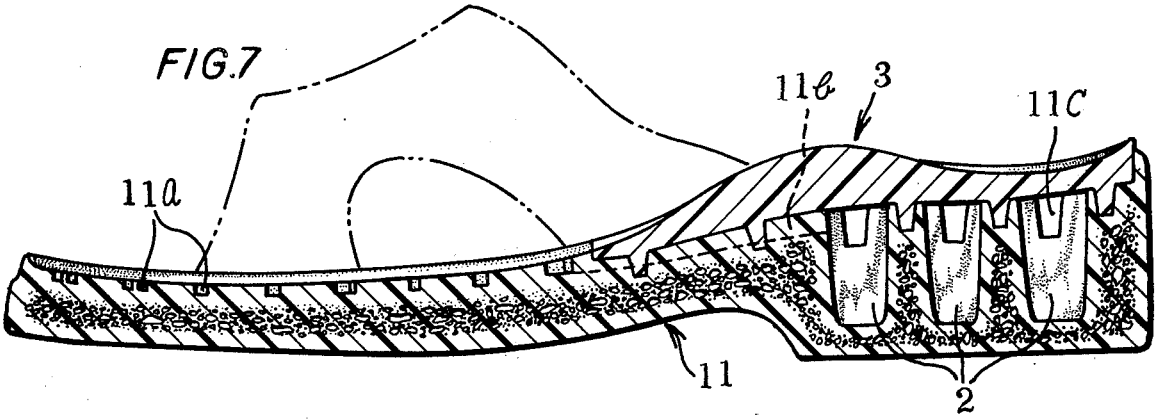
FIG. 7 is a longitudinal section of a sole for a sandal of another embodiment of the present invention.
Figure 8:
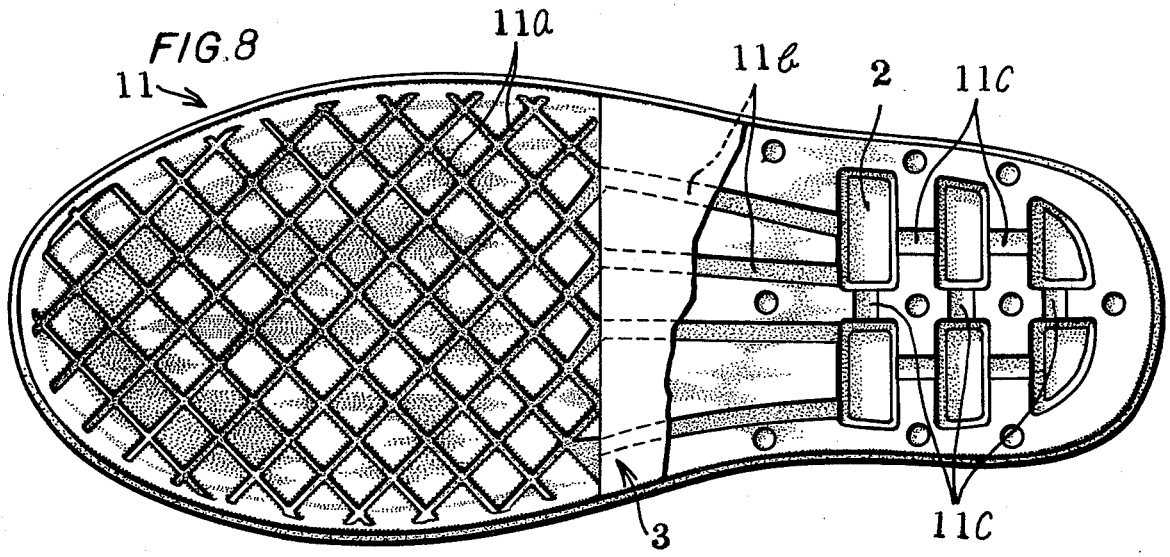
FIG. 8 is a partly cut-away plan view of the sole of FIG. 1.

A sole as shown in FIGS. 7 and 8 is a modification of a sole of FIGS. 1 and 2, in which there are provided a plurality of grooves 11*a* . . . opening upwardly in the front half of the sole body 11, a plurality of other grooves 11*b* . . . in the rear half of the sole body adapted to communicate the former grooves with recesses 2 . . . provided in the rear half, and a plurality of communicating grooves 11*c* . . . for communicating the recesses with one another. By such a construction, in the walking action, the rear half of the sole body, especially the heel section thereof, is compressed and restored, thereby increasing and decreasing the capacity of each recess 2 to effect pumping action therein. That is, air in each recess 2 is sent through the grooves 11*b* below the reinforcing plate 3 into the grooves 11*a* in the front half of the sole body whereby air is blown between the footsole and the upper surface of the front surface of the sole body and conversely outside air is sent through the grooves 11*a* and 11*b* into the recesses 2 . . . , thus affording to effect ventilation always in the walking action to improve comfortableness-to-wear of the sandal. Ventilation is especially required on hot days in summer. The non-rigid foamed synthetic resin material of the sole becomes softer as the temperature rises, thereby strengthening the pumping action in the recesses 2 caused by the displacement of the wearer's weight applied on the sole body in the walking action.

Figure 9:
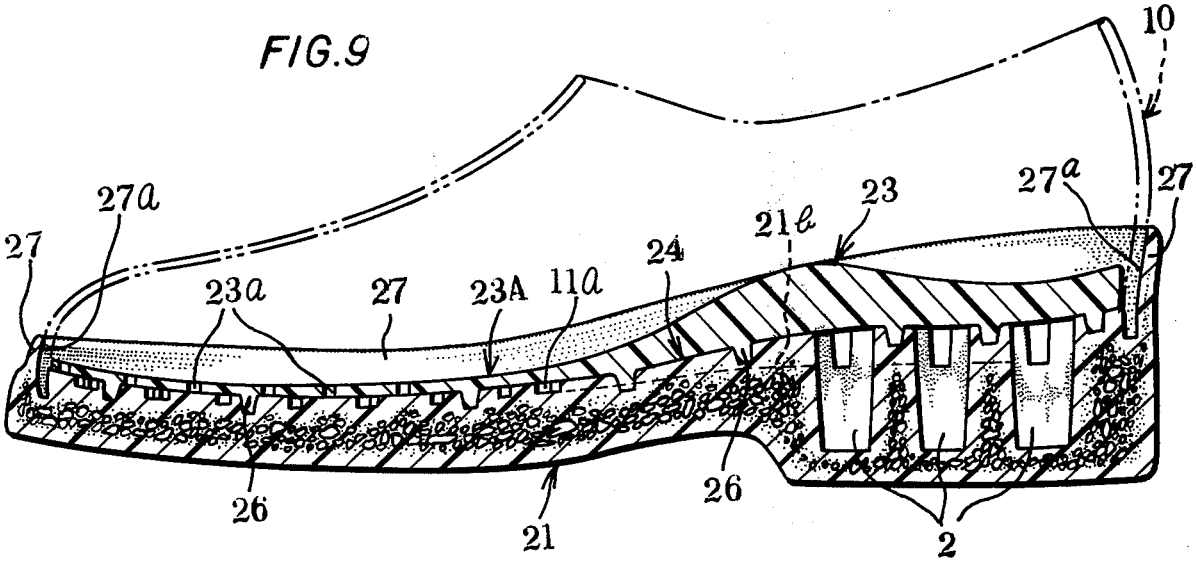
FIG. 9 is a longitudinal section of a sole for a shoe of a further embodiment of the present invention.
Figure 10:
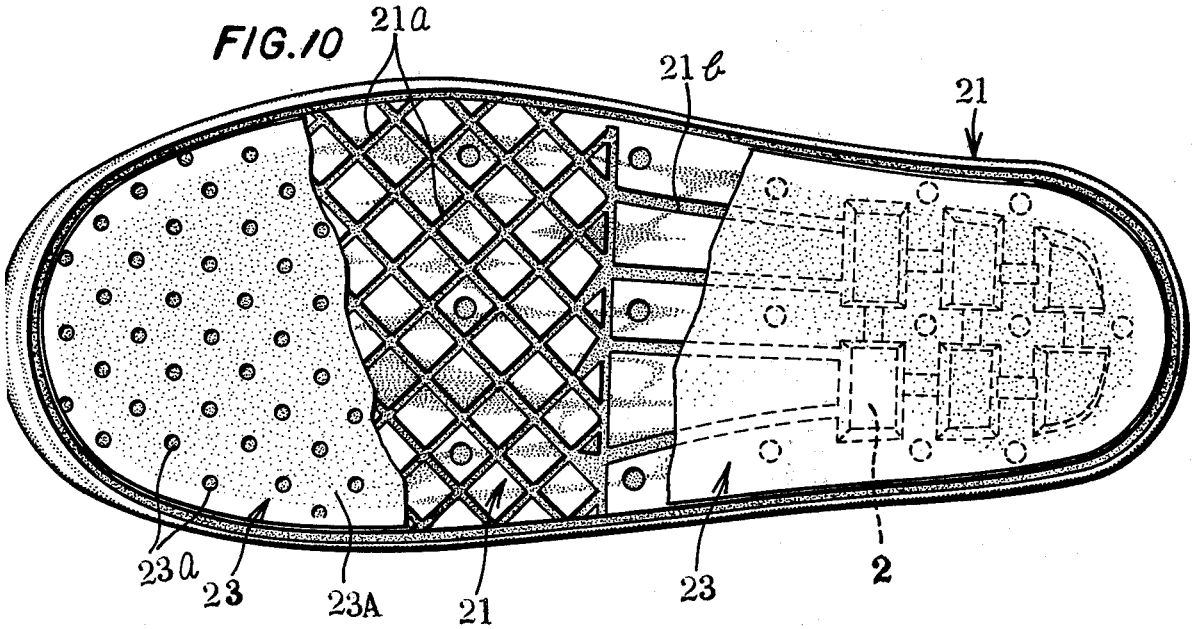
FIG. 10 is a partly cut-away plan view of the sandal of FIG. 1.

FIGS. 9 and 10 illustrate a shoe in which a reinforcing plate serving also as an insole as shown in FIG. 6 and a sole body as shown in FIGS. 7, 8 are applied. The reinforcing plate 23 serving also as an insole has a front section 23A extended forwardly so as to cover the front half of the sole body 21, the extended front section being provided with a number of through holes. And the reinforcing plate is fixed through a plurality of projections 26 . . . provided on the rear surface thereof to the sole body 21. The sole body 21 is provided at the periphery thereof with a peripheral wall 27 integrally extended upwardly from the upper surface thereof by a suitable height and having a curved inside surface 27*a* corresponding to the lower periphery of an upper to be connected therewith. Further, the inside of the peripheral wall 27 is provided with a groove 28 along the wall, into which the lower peripheral edge of the upper 10 as shown in imaginary line FIG. 9 is fitted. The peripheral wall 27 and the lower peripheral edge of the upper are connected together by seaming with thread or an adhesive agent. The sole body 21 is molded of non-rigid synthetic resin material e.g. a non-rigid PVC compound, while the reinforcing plate 23 serving also as an insole is molded of a rigid PVC compound.

The sole body 21 has substantially the same construction and functions as those of the sole body of FIGS. 5 and 6. In the walking action, air in the recesses 2 . . . flows through the groove 21*b* into the groove 21*a* in the front half of the sole body, past the through holes 23*a* . . . in the reinforcing plate into the upper 10 of the shoe, or air in the upper is sucked through the said through holes 23*a* to the recesses 2 . . . in the rear half of the sole body, thereby effecting ventilation. The reinforcing plate 23 may be further provided with small holes communicated with the pumping chambers or the recesses 2 . . . , while, if desired, outside air holes may be provided in the non-rigid synthetic resin section of the lateral peripheral wall of the pumping chamber near the bottom so as to be communicated with outside for improving ventilation.

In the sole as shown in FIGS. 7 – 10, in which pumping action is effected, the reinforcing plate and the upper surface of the sole body need to be closely contacted together for maintaining air tightness. Therefore, in mounting the reinforcing plate, preferably, it is surely and closely fixed to the sole body by using an adhesive agent as well as fitting its projections into the recesses in the latter.

As mentioned above, a sole according to the present invention comprises a sole body including the front and rear halves thereof formed of non-rigid synthetic resin material and a suitable thick reinforcing plate mounted on the said rear half, the sole as a whole has regiliency and pliability, with the soft and flexible front half and the rigid and inflexible rear half, permitting the improvement in walking efficiency as well as preventing fatigue of the foot through a long time use. Therefore, according to the present invention an ideal footwear can be provided. Further, since the recesses are formed in the rear half of the sole body so as to open upwardly, soil or pebble is prevented from intruding into the bottom thereof and at the same time the sole and consequently the footwear become lighter in weight. Lastly, since the reinforcing plate (shape-retaining member) is situated on the upper portion of the footwear, variety in design is achieved by varifying the color and shape of the sole body of non-rigid synthetic resin material.

What I claim is:

1. A sole of a footwear comprising a soft sole body provided at a rear half thereof with at least one upwardly opening recess and a reinforcing plate serving also as an insole which is mounted on said rear half of said sole body so as to cover said recess, said reinforcing plate comprising a body formed of relatively rigid synthetic resin material and a metal frame embedded into said body.

2. A sole of a footwear comprising a sole body provided at a rear half thereof with at least one upwardly opening recess and a relatively rigid reinforcing plate serving also as an insole which is mounted on said rear half of said sole body so as to cover said recess, said reinforcing plate being extended from the rear half of said sole body to the front half surface of said sole body so as to cover substantially the whole surface of said sole body, said extended portion being formed thinner than the reinforcing plate on the rear half of said sole body so as to provide the extended portion with suitable flexibility, said sole body being provided at the front half surface thereof with a plurality of grooves each opening upwardly and communicated with one another, said extended portion of said reinforcing plate being provided with a plurality of through holes passing through the front and back surfaces thereof and communicated with said grooves, and said grooves being also communicated through at least one communicating channel formed substantially in the intermediate portion of said sole body with said recesses in the rear half of said sole body.

3. A sole of a footwear comprising a soft sole body provided at a rear half thereof with at least one upwardly opening recess and a relatively rigid reinforcing plate serving also as an insole which is mounted on said rear half of said sole body so as to cover said recess, said reinforcing plate being extended from the rear half of said sole body to the front half surface of said sole body so as to cover substantially the whole surface of said sole body, said extended portion being formed thinner than the reinforcing plate on the rear half of said sole body so as to provide the extended portion with suitable flexibility, said reinforcing plate being provided with a plurality of projections downwardly extended integrally from the lower surface thereof, said projections being adapted to be fitted into a plurality of holes provided in the upper surface of said sole body, whereby said reinforcing plate is removably secured to said sole body.

4. A sole of a footwear comprising a soft sole body provided at a rear half thereof with at least one upwardly opening recess and a reinforcing plate serving also as an insole which is mounted on said rear half of said sole body so as to cover said recess, said reinforcing plate being extended from the rear half of said sole body to the front half surface of said sole body so as to cover substantially the whole surface of said sole body, said extended portion being formed thinner than the reinforcing plate on the rear half of said sole body so as to provide the extended portion with suitable flexibility, said reinforcing plate comprising a body formed of relatively rigid sythetic resin material and a frame embedded therein.

5. A sole of a footwear comprising an injection molded plastic soft and flexible sole body having front and rear ends and provided in the rear half thereof with at least one upwardly opening recess and a reinforcing plate serving also as an insole which is mounted on the rear half of said sole body over said recess and which extends from the rear end of the sole body to the approximate midportion of the sole body, the reinforcing plate being formed of relatively rigid material whereby the reinforcing plate rigidifies the rear portion of the sole and maintains the shape of the sole while the front portion of the sole remains soft and flexible.

6. The sole of claim 5 in which the reinforcing plate is removably connected to the sole body.

7. The sole of claim 5 in which the reinforcing plate includes a plurality of downwardly extending projections, the sole body being provided with a plurality of recesses into which the projections are removably inserted wherey the reinforcing plate is removably connected to the sole body.

8. The sole of claim 5 in which the front half of the sole body is provided with a plurality of upwardly opening grooves which communicate with said recess in the rear half of the sole body.

* * * * *